US006262381B1

(12) United States Patent
Kikuchi et al.

(10) Patent No.: US 6,262,381 B1
(45) Date of Patent: Jul. 17, 2001

(54) MULTI-CONTACT INPUTTING DEVICE

(75) Inventors: Toshio Kikuchi, Nara-ken; Yoshihisa Mimata, Higashiosaka, both of (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 09/676,947

(22) Filed: Oct. 2, 2000

(30) Foreign Application Priority Data

Mar. 29, 2000 (JP) ..... 12-092065

(51) Int. Cl.[7] ..... H01H 25/04
(52) U.S. Cl. ..... 200/6 A; 20/335; 20/406
(58) Field of Search ..... 200/4, 6 R, 6 A, 200/17 R, 18, 517, 332, 335, 406

(56) References Cited

U.S. PATENT DOCUMENTS 4,473,725 * 9/1984 Kim ..... 200/6 A
5,430,262 * 7/1995 Matsui et al. ..... 200/5 A
5,744,765 * 4/1998 Yamamoto ..... 200/6 A
5,952,628 * 9/1999 Sato et al. ..... 200/4

* cited by examiner

*Primary Examiner*—Michael Friedhofer
(74) *Attorney, Agent, or Firm*—Jones, Tullar & Cooper, P.C.

(57) ABSTRACT

A multi-contact inputting device has a center switch (S1) and plural side switches (S2) that are placed around the center switch (S1). The multi-contact inputting device is used for inputting and outputting different signals by operating an operation member (7). The movable electrodes (41, 42) are placed so as to overlap with each other in the thickness direction of the body (1). Arranging the movable electrodes (41, 42) in the manner described above, realizes miniaturization and compaction of the multi-contact inputting device. Each of the center switch (S1) and the side switches (S2) is formed by a stationary electrode (31, 32) and a movable electrode (41, 42) configured by a snap plate. The movable electrode (41) of the center switch (S1) and the movable electrodes (42) of the side switches (S2) are placed so as to overlap with each other in the thickness direction of the body (1), and hence the size of the body (1) can be reduced by a degree corresponding to the overlapping width (D).

10 Claims, 9 Drawing Sheets

MULTI-CONTACT INPUTTING DEVICE

BACKGROUND OF THE INVENTION

1. Field of the Invention

The present invention relates to a multi-contact inputting device, and more particularly to a multi-contact inputting device which has a center switch and plural side switches that are placed around the center switch, and in which the center switch and the side switches are individually opened and closed by operating an operation member.

2. Description of the Prior Art

A multi-contact inputting device is used for inputting and outputting different signals by operating one or plural operation members. Among conventional art multi-contact inputting devices of this kind, a device is employed in which each of the center switch and the side switches is formed by combining a stationary electrode, and movable electrodes each configured by a snap plate covering the stationary electrode. In such a device, spaces for respectively accommodating the movable electrodes each configured by a snap plate are formed by partitioning the body so as not to overlap with each other.

In the multi-contact inputting device of the conventional art, the body in which the center switch and the side switches are placed must be formed into a size which allows the movable electrodes each configured by a snap plate to be placed so as not to overlap with each other in the thickness direction of the body. Consequently, there arises a situation in which the size of the body is determined by the size and the number of the snap plates forming the movable electrodes. As a result, the concept that the movable electrodes each configured by a snap plate are placed so as not to overlap with each other in the thickness direction of the body constitutes one of obstacles to reduce the size of the body so as to attain miniaturization and compaction of the whole shape of a multi-contact inputting device.

SUMMARY OF THE INVENTION

The present invention has been conducted in view of the above-mentioned circumstances under the concept that, unlike the conventional art, movable electrodes constituting a center switch and plural side switches and each configured by a snap plate are placed so as to overlap with each other in the thickness direction of the body.

It is an object of the invention to arrange movable electrodes in the manner described above, whereby miniaturization and compaction of the whole shape of a multi-contact inputting device are easily realized.

It is another object of the invention to prevent movable electrodes of a center switch and side switches from being positionally deviated, to enhance their operation reliability.

It is a further object of the invention to enable such movable electrodes to be positioned without increasing the number of parts.

It is a still further object of the invention to prevent a situation in which a movable electrode of each of side switches that is placed overlapping with a movable electrode of a center switch interferes with the movable electrode of the center switch to damage the movable electrodes, from occurring even when the movable electrode of the side switch is operated via an operation member to be flexurally deformed.

Referring to the accompanying drawings, the multi-contact inputting device of the invention will be described. The reference numerals in the figures are used in this paragraph in order to facilitate the understanding of the invention, and the use of the reference numerals is not intended to restrict the contents of the invention to the illustrated embodiments.

The multi-contact inputting device according to the invention has a center switch S1, and plural side switches S2 which are placed around the center switch S1. Each of the center switch S1 and the plural side switches S2 is formed by: a stationary electrode 31 or 32 disposed in a body 1; and a stationary electrode 41 or 42 configured by a snap plate which is placed so as to be separable from and contactable with the stationary electrode 31 or 32, and to cover the stationary electrode 31 or 32. The device further comprises an operation member 7 which can individually open and close the center switch S1 and the side switches S2. A plurality of such operation members may be provided for each of the center switch and the side switches. Alternatively, a single operation member which can individually operate the center switch and the plural side switches may be provided.

In the multi-contact inputting device according to the invention, the plural side switches S2 are placed so that a part of the movable electrode 42 of each of the side switches overlaps with the movable electrode 41 of the center switch S1 in a thickness direction of the body 1. When this configuration is employed, the spaces for respectively accommodating the movable electrodes 41 and 42 can be narrowed by a length corresponding to the overlapping width D of the electrodes, as compared with a configuration such as that of the conventional multi-contact inputting device described in the beginning, in which the movable electrode of the center switch and the movable electrodes of the plural side switches are placed so as not to overlap with each other in the thickness direction of the body. This is useful for reducing the size of the body 1 to expedite miniaturization and compaction of the whole shape of a multi-contact inputting device. In the invention, the movable electrode of the center switch S1 may be placed so as to overlap above the movable electrodes of the plural side switches S2, or alternatively the movable electrodes of the plural side switches S2 may be placed so as to overlap above the movable electrode of the center switch S1.

In the invention, it is preferable to dispose positioning means for positioning the movable electrode 41 of the center switch S1 and the movable electrodes 42 of the side switches S2 to predetermined positions which are formed by partitioning the body 1. According to this configuration, positional relationships among the movable electrodes 41 and 42 of the center switch S1 and the side switches S2 are suitably defined, and hence a situation in which any one of the movable electrodes 41 and 42 is positionally deviated to impair the operation reliability does not occur.

In the invention, preferably, a recess 22 into which the movable electrode 41 of the center switch S1 is to be fitted, and recesses 21 into which the movable electrodes 42 of the side switches S2 are to be respectively fitted are disposed in the body 1, and the positioning means is formed by the recesses 22 and 21. When the movable electrodes 41 and 42 are fitted into the recesses 22 and 21 formed in the body 1 so as to perform positioning as described above, extra parts for positioning the movable electrodes 41 and 42 are not necessary, and hence it is possible to prevent the body structure from being complicated.

In the case where the positioning means for the movable electrodes 41 and 42 is formed by the recesses 22 and 21 as described above, preferably, the movable electrode 41 of the center switch S1 and the movable electrodes 42 of the side switches S2 have an arcuate section shape which upward swells, an outer peripheral edge of the movable electrode 41 of the center switch S1 is seated on a bottom face of the recess 22 for positioning the movable electrode 41 of the center switch S1, outer peripheral edges of the movable electrodes 42 of the side switches S2 are seated on bottom faces of the recesses 21 for positioning the movable electrode 42 of the side switches S2, respectively, and steps H are formed between the bottom face of the recess 22 for positioning the movable electrode 41 of the center switch S1 and the bottom faces of the recesses 21 for positioning the movable electrode 42 of the side switches S2, respectively. According to this configuration, the outer peripheral edge of the movable electrode 41 of the center switch S1 is placed with being separated in the thickness direction of the body from the outer peripheral edges of the movable electrodes 42 of the side switches S2. Therefore, the outer peripheral edge of the movable electrode 41 of the center switch S1, and the outer peripheral edges of the movable electrodes 42 of the side switches S2 can be placed so as to overlap with each other in the thickness direction of the body 1.

In the invention, it is possible to employ a configuration in which the bottom faces of the recesses 21 into which the movable electrodes 42 of the side switches S2 are to be fitted, respectively are higher in level than the bottom face of the recess 22 into which the movable electrode 41 of the center switch S1 is to be fitted.

In the invention, it is possible to employ a configuration in which a common terminal 33 is placed on the bottom face of the recess 22 into which the movable electrode 41 of the center switch S1 is to be fitted, and the bottom faces of the recesses 21 into which the movable electrode 42 of the movable electrode 42 are to be fitted, respectively, so as to be electrically connected to each other, and the outer peripheral edge of the movable electrode 41 of the center switch S1 and the outer peripheral edges of the movable electrodes 42 of the side switches S2 are in contact with the common terminal 33. According to this configuration, there arises no obstacle even when the movable electrode 41 of the center switch S1 and the movable electrodes 42 of the side switches S2 which are placed so as to overlap with each other are in contact with each other to be electrically connected.

In the invention, preferably, gaps U are formed between an upper face of the movable electrode 41 of the center switch S1 and the outer peripheral edges of the movable electrodes 42 of the side switches S2, respectively, each of the gaps having an area which can absorb displacement of the outer peripheral edge of the movable electrode 42 of corresponding one of the side switches S2 due to flexural deformation that is caused when the movable electrode 42 is pressed down by the operation member 7. According to this configuration, even when the movable electrode 42 of the side switch S2 is operated via the operation member 7 to be flexurally deformed, a situation in which the movable electrode 42 of the side switch S2 interferes with the movable electrode 41 of the center switch S1 to damage the movable electrodes 41 and 42 does not occur.

In the invention, it is possible to employ a configuration in which the side switches S2 are placed in four positions at regular angular intervals around the single center switch S1, respectively, the movable electrode 41 of the center switch S1 and the movable electrodes 42 of the side switches S2 are configured by dome-like snap plates which have a circular shape in a plan view, and which have the same shape and size, respectively, the recesses 21 for positioning the movable electrodes 42 of the side switches S2 are separated from one another by four partition walls 13 which form the recesses 21, and a recess surrounded by inner end faces 14 of the partition walls 13 is formed as the recess 22 for positioning the movable electrode 41 of the center switch S1. According to this configuration, the one center switch S1 and the four side switches S2 are selectively used so that plural kinds (for example, five kinds) of signals can be input and output.

As descried above, according to the invention, while exerting the same inputting and outputting abilities as those of a multi-contact inputting device of the conventional art, miniaturization and compaction of the whole shape of the device can be easily realized.

DETAILED DESCRIPTION OF THE PREFERRED EMBODIMENT

Figure 1:
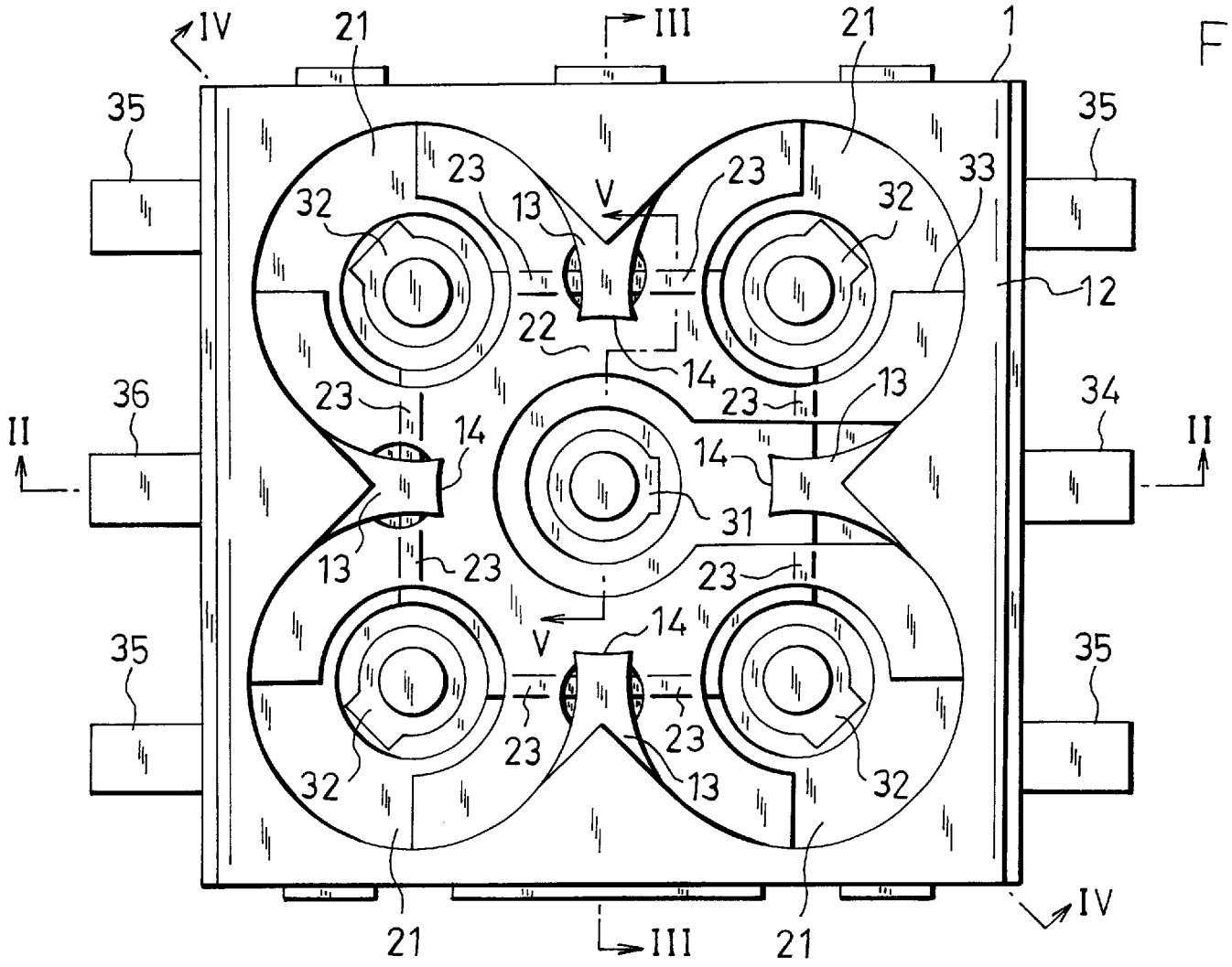
FIG. 1 is a plan view showing the structure of the body of a multi-contact inputting device which is an embodiment of the invention.
Figure 2:
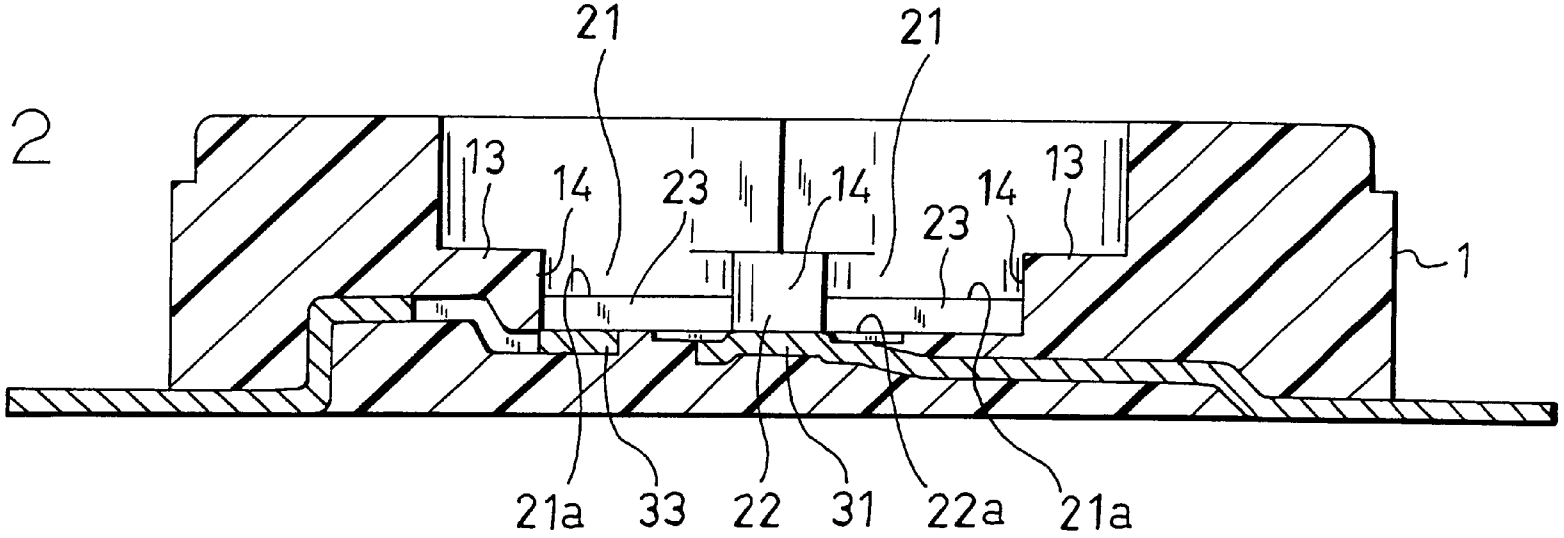
FIG. 2 is a section view taken along the line II—II of FIG. 1.
Figure 3:
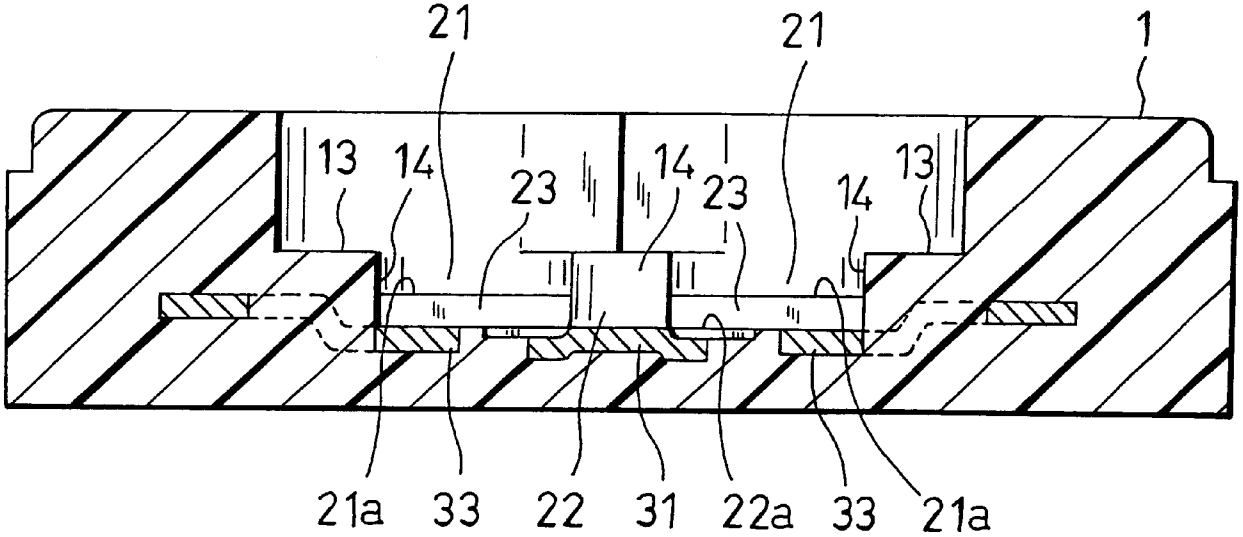
FIG. 3 is a section view taken along the line III—III of FIG. 1.
Figure 4:
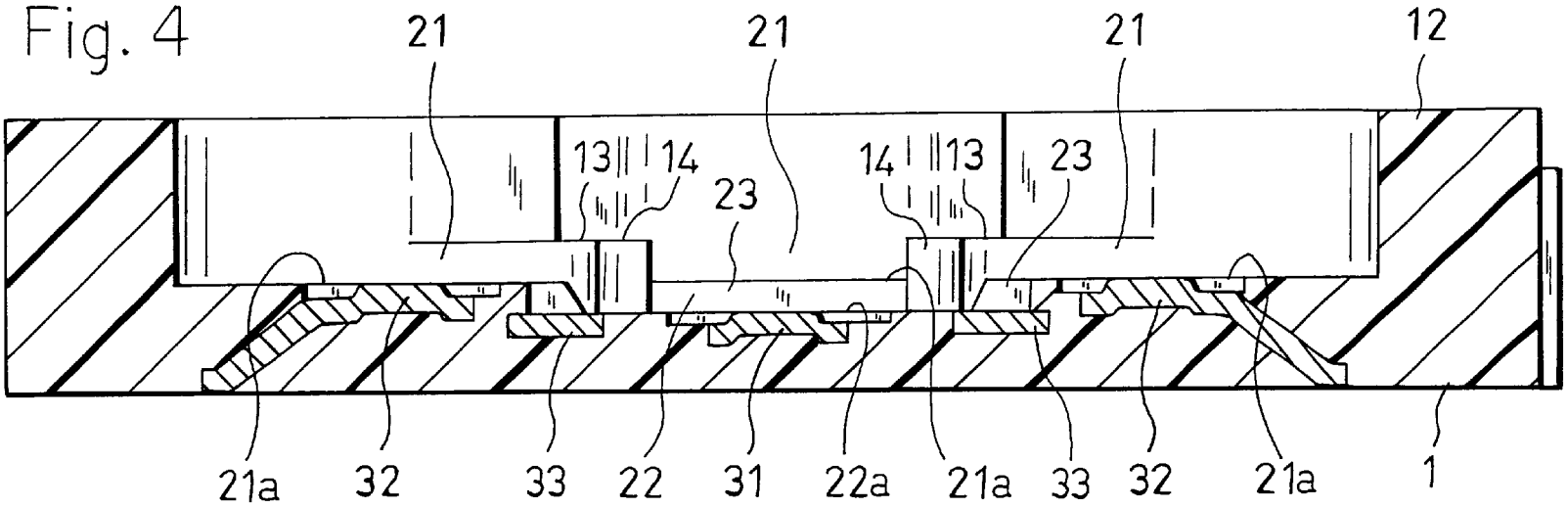
FIG. 4 is a section view taken along the line IV—IV of FIG. 1.

As shown in FIGS. 1 to 4, a body 1 is configured by a flat synthetic resin molded piece which has a substantially square shape in a plan view. The body 1 comprises a peripheral wall 12 which forms the outer peripheral edge of the body 1. The body 1 further comprises four partition walls 13 which inward protrude from four positions of the peripheral wall 12 and arranged at regular angular intervals, respectively. Four recesses 21 which are located at regular angular intervals are formed by the inner face of the peripheral wall 12, and the both side faces of the four partition walls 13. A single center recess 22 is formed in a portion surrounded by the inner end faces 14 of the four partition walls 13.

As seen from FIG. 1, each of the four recesses 21 separated by the four partition walls 13 is a circular recess in which the inner face is formed as an arcuate face. Furthermore, the inner end faces 14 of the partition walls 13 forming the single center recess 22 are formed as arcuate faces the center of which coincide with one another.

Therefore, also the recess 22 is a circular recess. The single center recess 22 communicates with the four surrounding recesses 21 through spaces between adjacent ones of the partition walls 13.

Figure 5:
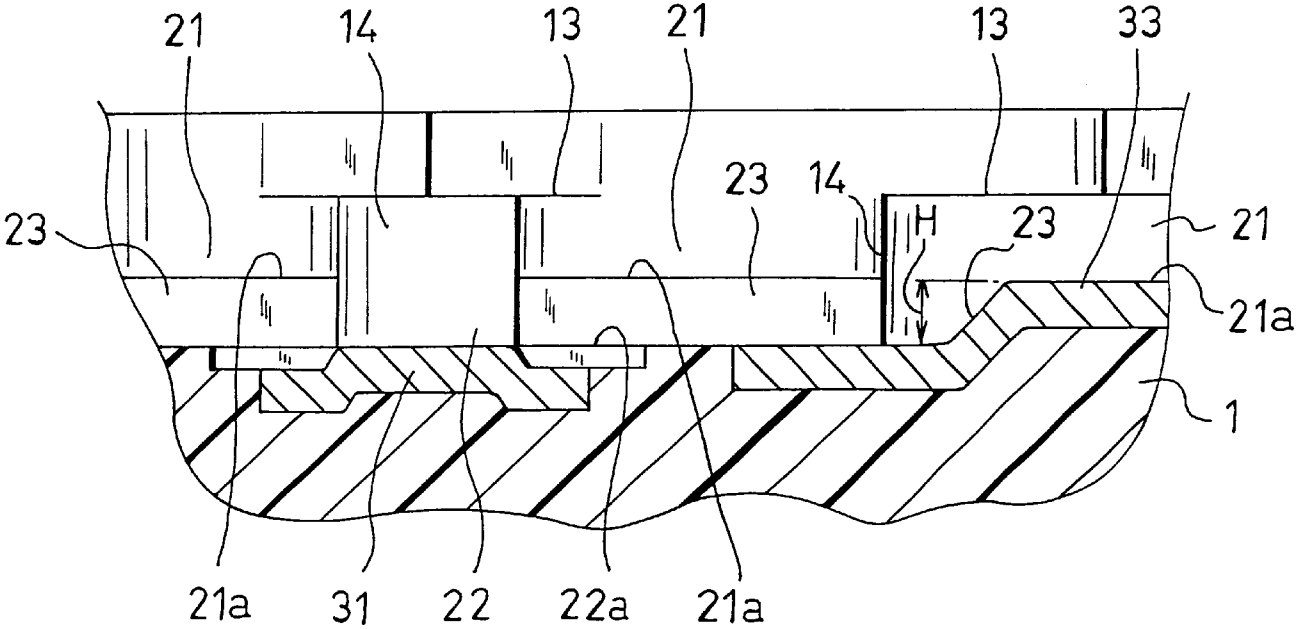
FIG. 5 is an enlarged section view taken along the line V—V of FIG. 1.

In a region including the single center recess 22 and the four surrounding recesses 21 shown in FIG. 1, steps H shown in FIG. 5 are formed in boundary portions 23 between the substantially square region including the whole of the center recess 22 and the regions outsides the square region, respectively. Across each of the boundary portions 23, the substantially square region including the whole of the center recess 22 is stepwise lower than the outer region. According to this configuration, bottom faces 21*a* of the four surrounding recesses 21 are located at a level which is higher by one step than a bottom face 22*a* of the center recess 22.

As shown in FIGS. 1 to 4, a stationary electrode 31 is placed on the bottom face 22*a* of the single center recess 22. The face of the stationary electrode 31 is flush with the bottom face 22*a* of the center recess 22. Stationary electrodes 32 are placed on the bottom faces 21*a* of the four surrounding recesses 21 which are located at a higher level than the bottom face 22*a* of the center recess 22, respectively. The faces of the stationary electrodes 32 are flush with the bottom faces 21*a* of the recesses 21. On the bottom face 22*a* of the center recess 22 and the bottom faces 21*a* of the four surrounding recesses 21, a common terminal 33 which is formed by a single metal plate is placed with being electrically insulated from the stationary electrodes 31 and 32. The upper face of the common terminal 33 is flush with the bottom faces 21*a* and 22*a*.

Figure 8:
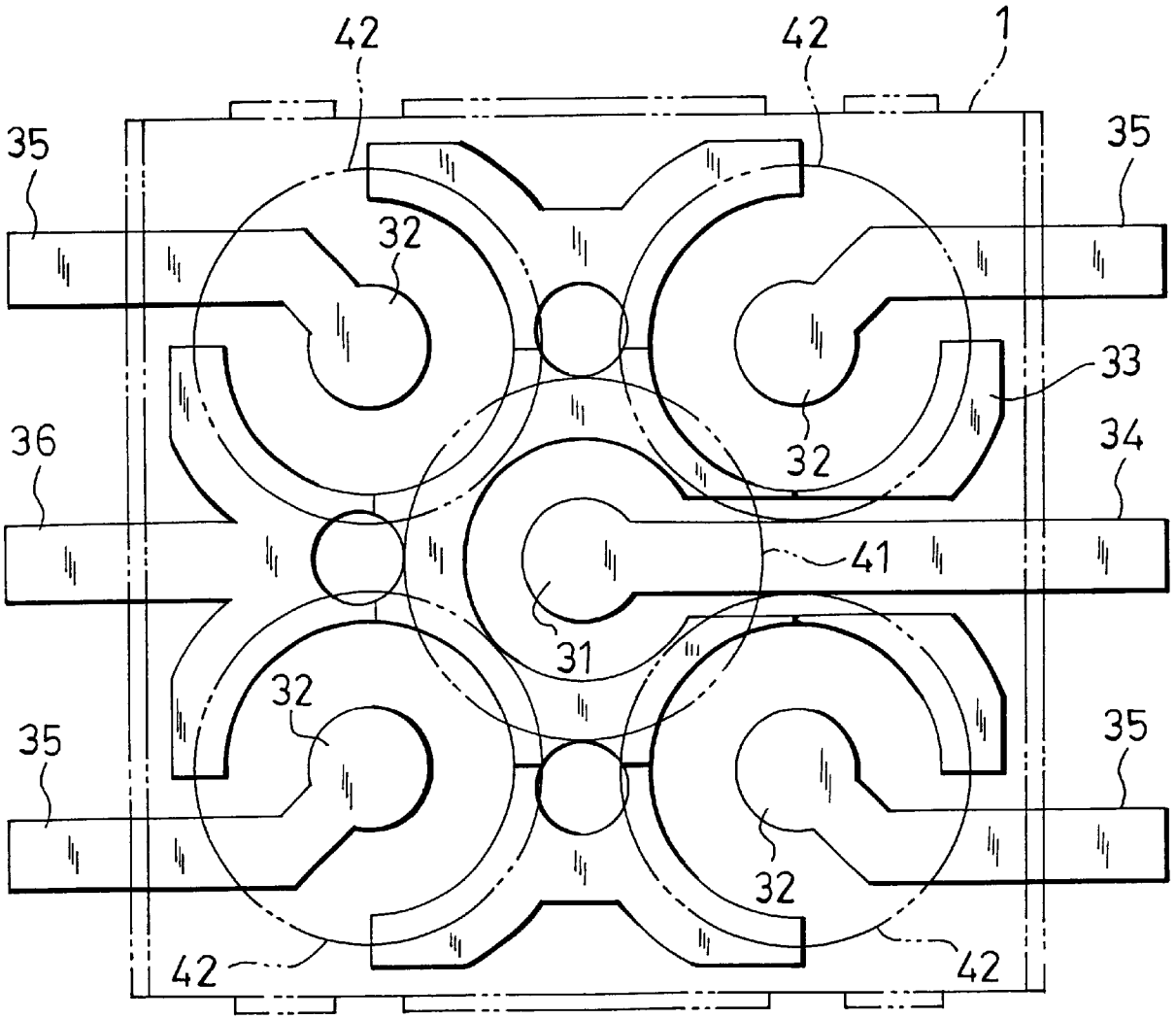
FIG. 8 is a diagram exemplarily showing an arrangement pattern of stationary electrodes, a common terminal, and the like which are embedded into the body.

As seen from FIG. 8, a soldering terminal 34 is formed continuously with the stationary electrode 31 which is placed in the center recess 22. Soldering terminals 35 are formed continuously with the stationary electrodes 32 which are placed in the four surrounding recesses 21, respectively. A soldering terminal 36 is formed continuously with the common terminal 33. With respect to the soldering terminals 34, 35, and 36, sets each configured by three soldering terminals are distributed to the right and left sides of the body 1, respectively, and laterally protrude therefrom. In the illustrated example, the soldering terminals 34, 35, and 36 are of the surface mount type. Alternatively, the soldering terminals 34, 35, and 36 may be formed as those of the pin type.

Figure 6:
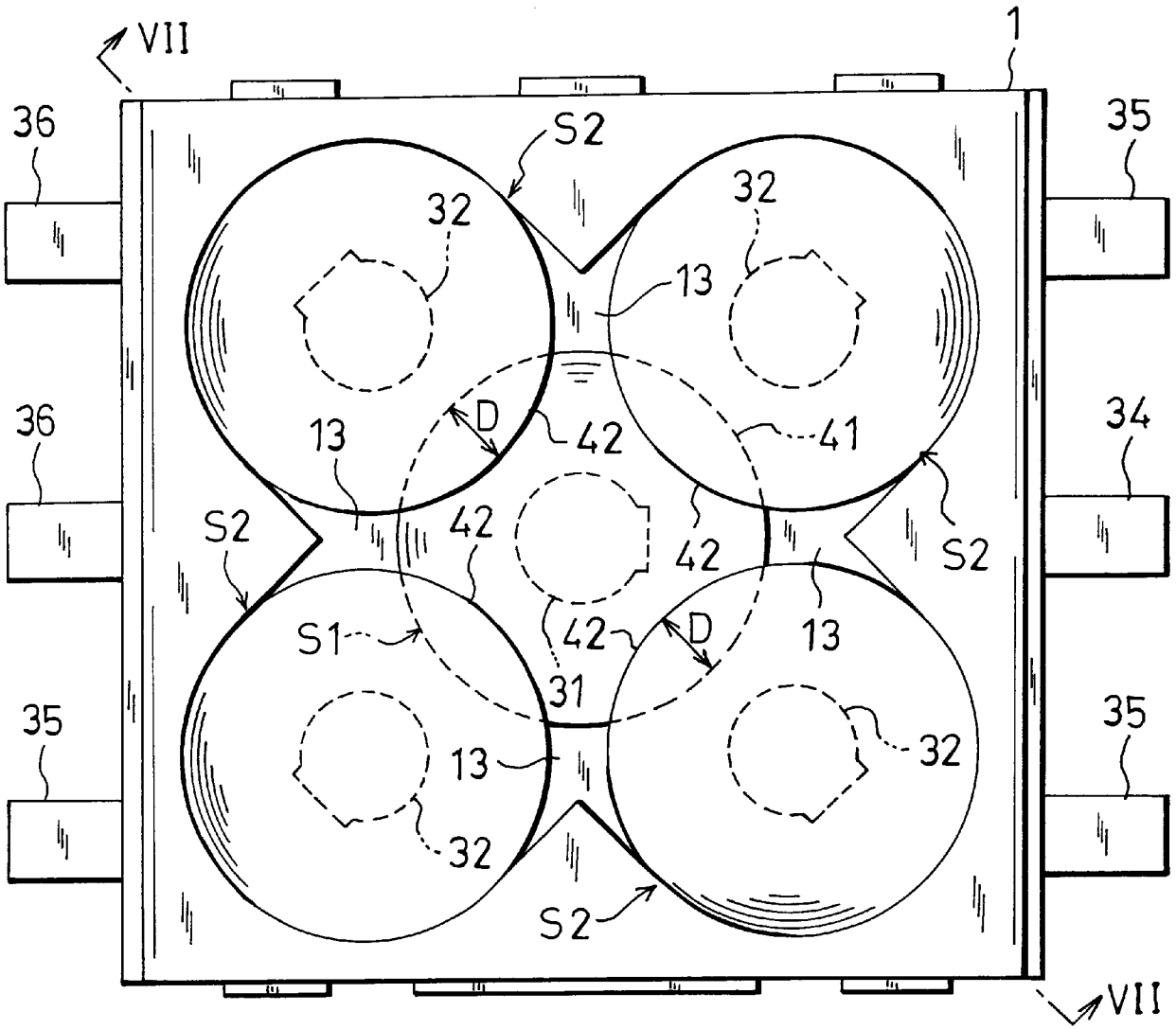
FIG. 6 is a schematic plan view of a state where movable electrodes are placed in predetermined positions of the body 1 of FIG. 1.
Figure 7:
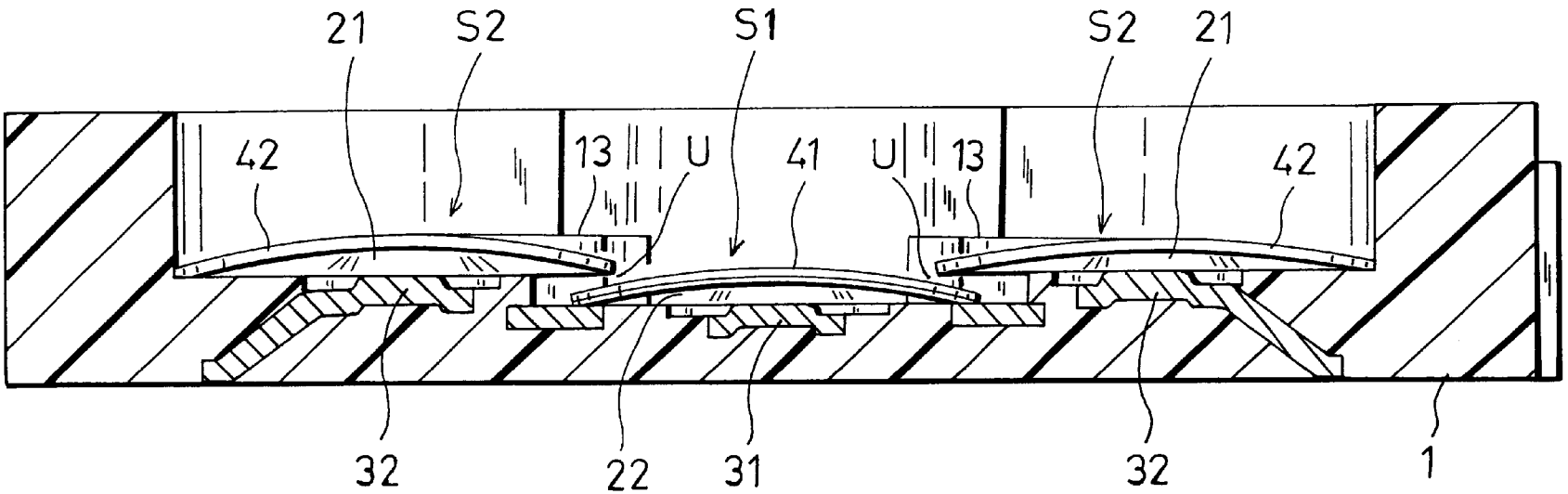
FIG. 7 is a section view taken along the line VII—VII of FIG. 6.

The center recess 22 and the four surrounding recesses 21 have the same diameter. As shown in FIGS. 6 and 7, movable electrodes 41 and 42 respectively configured by dome-like snap plates which have a circular shape in a plan view, and which have the same shape and size are fitted into the recesses 21 and 22, respectively. Outer peripheral edges of the movable electrodes 41 and 42 are seated on the bottom faces 22*a* and 21*a* of the recesses 22 and 21 under the condition that the movable electrodes are in contact with the common terminal 33. The movable electrode 41 which is fitted into the center recess 22 is formed by stacking two snap plates of the same size and shape. The movable electrodes 41 and 42 are slightly smaller in diameter than the recesses 22 and 21. Therefore, the movable electrode 41 which is fitted into the center recess 22 can be flexurally deformed in the center recess 22 with accompanying a snap operation, and the movable electrodes 42 which are fitted into the four surrounding recesses 21 can be flexurally deformed in the recesses 21 with accompanying a snap operation, respectively. A part of each of the movable electrodes 42 which are fitted into the four surrounding recesses 21 is placed so as to, in the thickness direction of the body 1, overlap with respective one of four portions of the outer periphery of the movable electrode 41 which is fitted into the center recess 22. The stationary electrode 31 on the bottom face 22*a* of the center recess 22, and the movable electrode 41 which is fitted into the recess 22 so as to cover the stationary electrode constitute the center switch S1. The stationary electrodes 32 on the bottom faces 21*a* of the four surrounding recesses 21, and the movable electrodes 42 which are respectively fitted into the recesses 21 so as to cover the stationary electrodes 32 constitute the four side switches S2.

According to this configuration, with respect to the movable electrode 41 of the center switch S1, the movable electrodes 42 of the four side switches S2 surrounding the center switch are placed so as to partly overlap in the thickness direction of the body 1. When the center switch S1 is placed in the center of the body 1 and the four side switches S2 are placed with being distributed with respect to the center switch S1 in diagonal directions of the body 1 as shown in, for example, FIG. 6, therefore, the diagonal length of the body 1 can be shortened by a length corresponding to the overlapping widths D between the movable electrode 41 of the center switch S1 and the movable electrodes 42 of the two side switches S2 which are placed in a diagonal direction of the body, as compared with the case where the movable electrode 41 are placed so as not overlap with two the movable electrodes 42. Each of the movable electrodes 41 and 42 of the center switch S1 and the four side switches S2 is individually positioned by the respective one of the recesses 22 and 21 so as not to be positionally deviated. Consequently, the operation reliability of the opening and closing operations of the center switch S1 and the side switches S2 can be maintained to be excellent.

Figure 9:
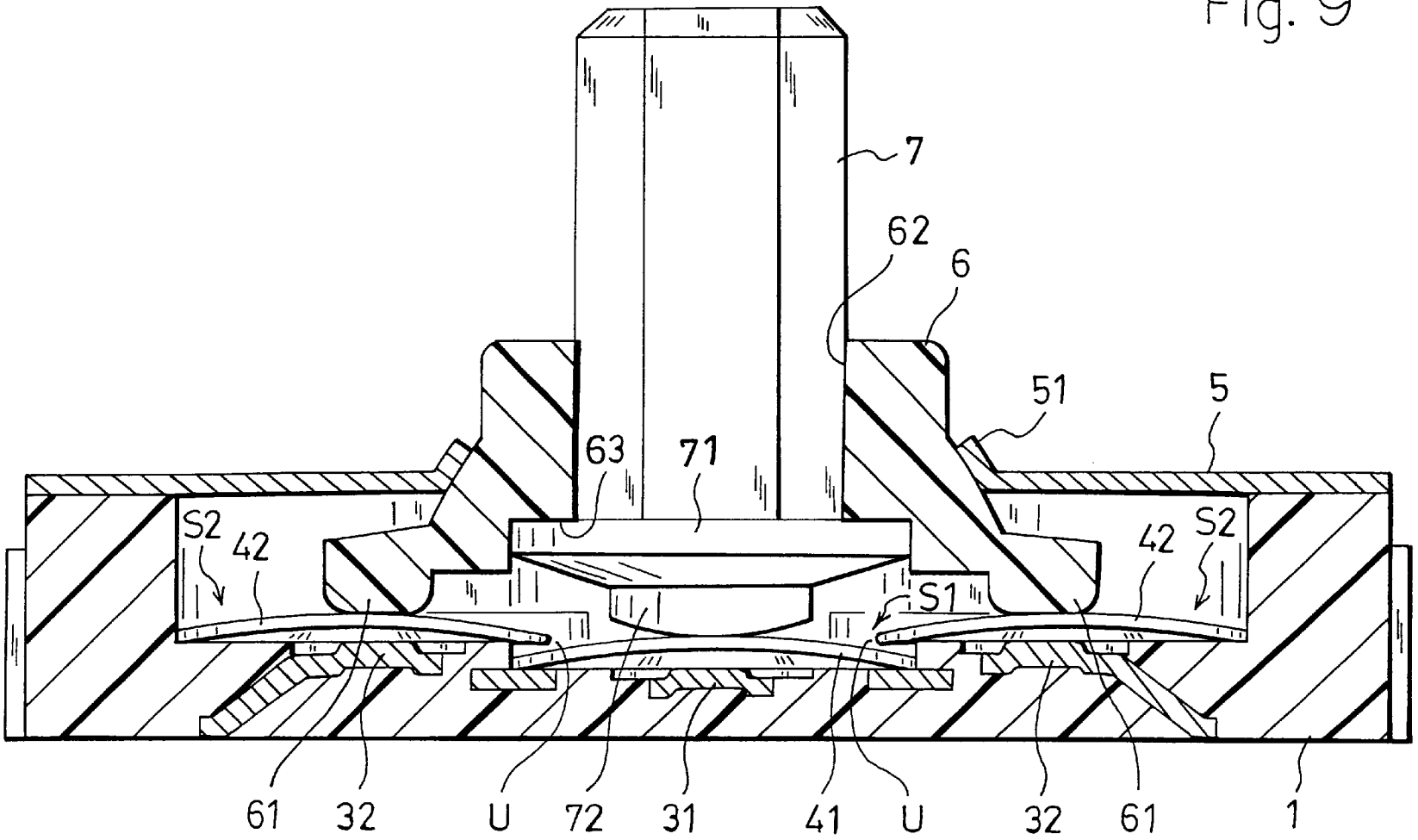
FIG. 9 is a section view of the multi-contact inputting device in the case where an operation member maintains a neutral posture.
Figure 10:
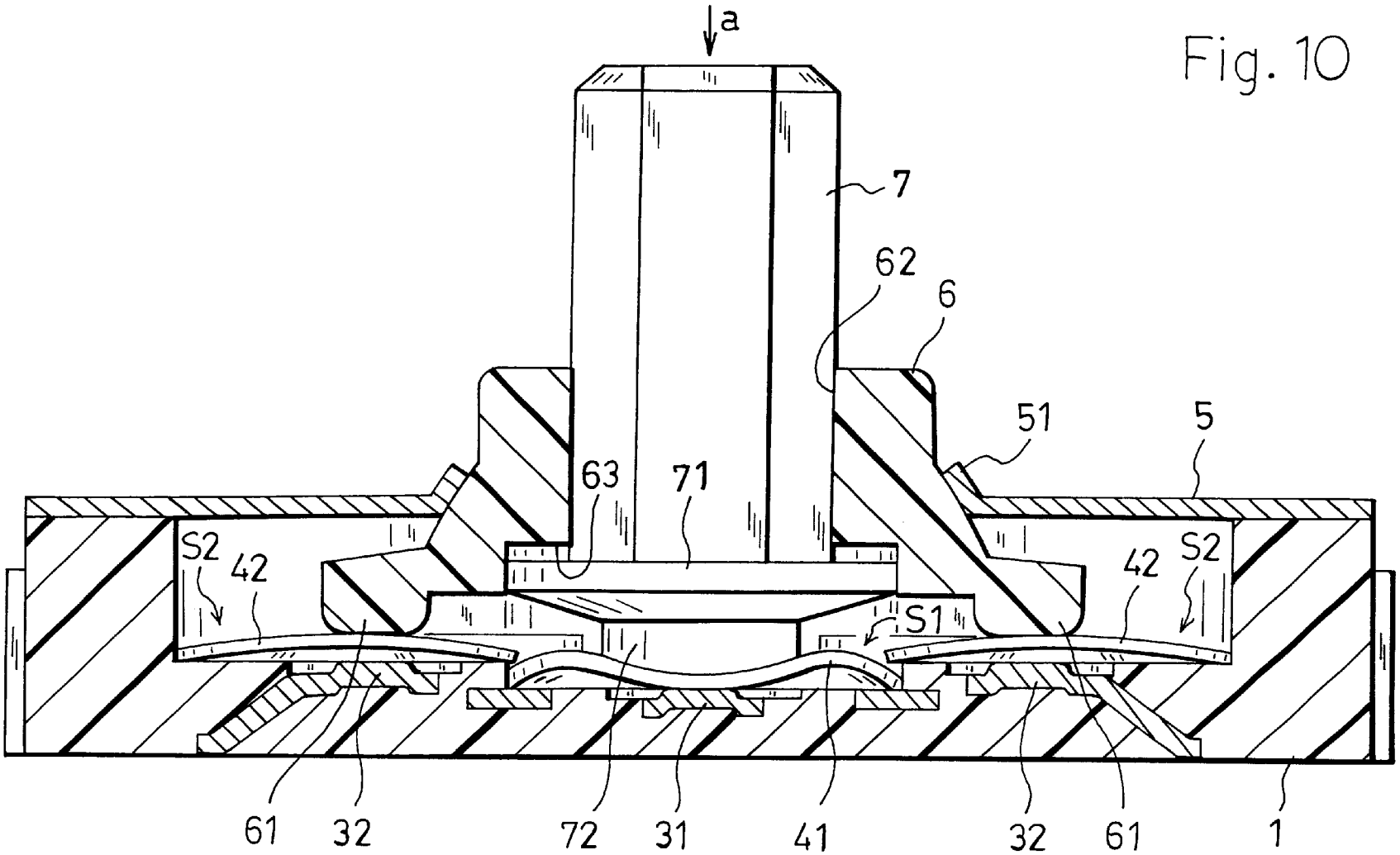
FIG. 10 is a section view of the multi-contact inputting device in the case where the operation member is pressed down.
Figure 11:
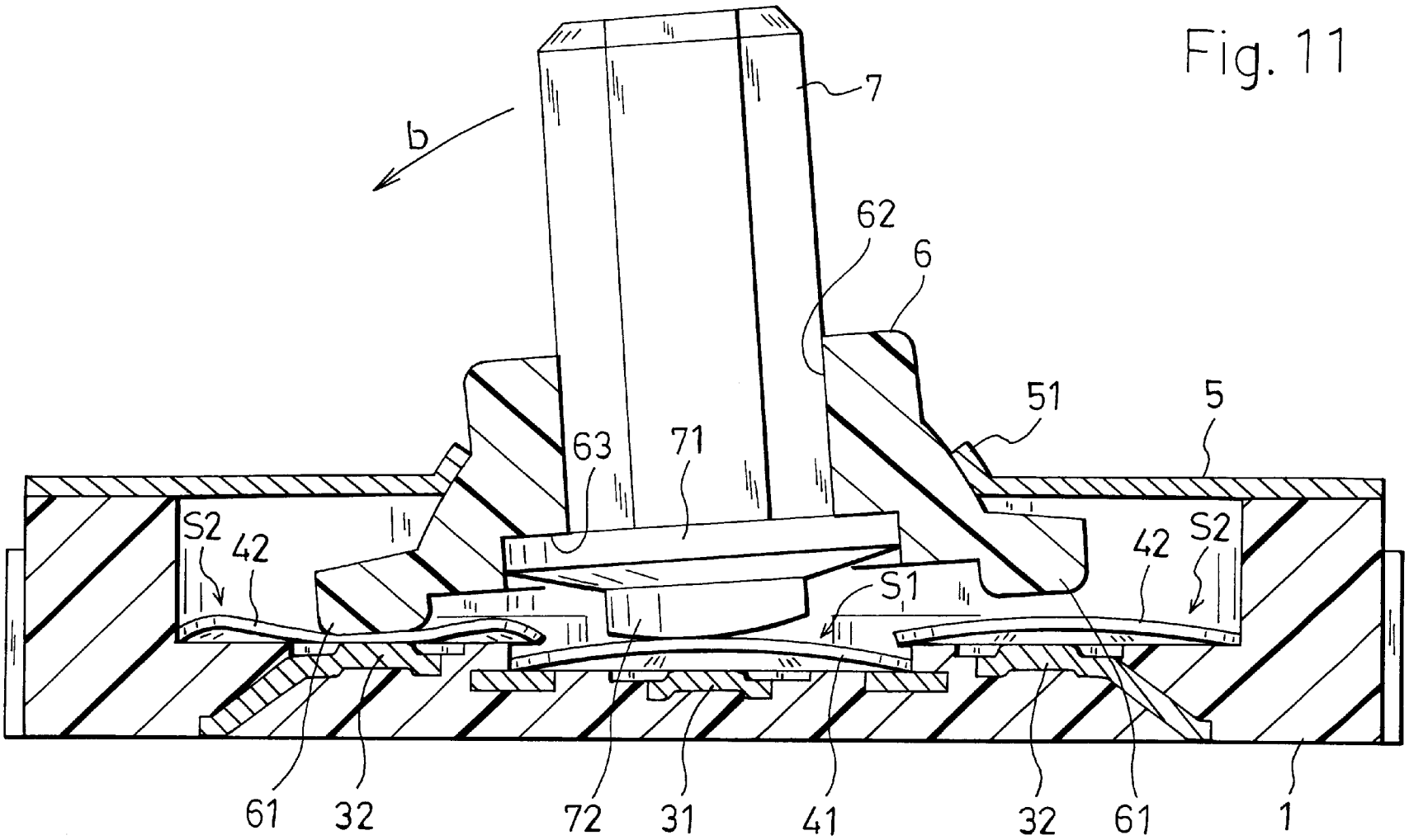
FIG. 11 is a section view of the multi-contact inputting device in the case where the operation member is tilted.

As shown in FIGS. 9 to 11, the body 1 is covered with a cover 5 made of a metal. A guide ridge 51 having a ring like shape in which the diameter is gradually reduced as moving upward is disposed in the center of the cover 5. A movable member 6 is held by the movable electrodes 42 and the cover 5 via the guide ridge 51 so as to be swingable in every direction. Pressing portions 61 which respectively correspond to the movable electrodes 42 of the four side switches S2 are disposed on the rear face of the movable member. An operation member 7 is passed through a center hole 62 of the movable member 6 so as to be axially slidable. A flange 71 which is formed integrally with a lower end portion of the operation member 7 is opposed to the lower face 63 of the movable member 6. A pressing portion 72 corresponding to the movable electrode 41 of the center switch S1 is disposed on the lower face of the flange 71.

In the thus configured multi-contact inputting device, when an external force such as that in a swinging direction or in the pressing direction is not applied to the operation member 7, the pressing portion 72 of the operation member 7 is supported by the movable electrode 41 of the center switch S1 as shown in FIG. 9, and the four pressing portions 61 of the movable member 6 are supported by the movable electrodes 42 of the four side switches S2, respectively. Therefore, the operation member 7 maintains a neutral posture in which the member stands upright.

When the closed or opened state of the center switch S1 is to be switched over, the operation member 7 is pressed down as indicated by the arrow a of FIG. 10. As a result, the operation member 7 is lowered with respect to the movable member 6, and the pressing portion 72 of the operation member 7 presses down the movable electrode 41 of the center switch S1 to cause the electrode to be flexurally deformed while performing a snap operation. As shown in the figure, therefore, the movable electrode 41 makes contact with the stationary electrode 31 to attain electrical conduction between the electrodes 41 and 31, whereby the closed or opened state of the center switch S1 is switched over.

When the closed or opened state of the predetermined one of the side switches S2 is to be switched over, the operation member 7 is swung toward the side switch S2 as indicated by the arrow b of FIG. 11. As a result, the movable member 6 is pushed by the operation member 7 to be tilted, and the predetermined one of the pressing portions 61 of the movable member 6 presses down the movable electrode 42 of the predetermined side switch S2 to cause the electrode to be flexurally deformed while performing a snap operation. As shown in the figure, therefore, the movable electrode 42 makes contact with the stationary electrode 32 to attain electrical conduction between the electrodes 42 and 32, whereby the closed or opened state of the side switch S2 is switched over. When the closed or opened state of another one of the side switches S2 is to be switched over, similar operations are performed.

In the embodiment, the operation member 7 is axially slidable with respect to the movable member 6. Therefore, the operation of pressing down the operation member 7 to switch over the closed or opened state of the center switch S1, and that of tilting the movable member 6 together with the operation member 7 to switch over the closed or opened state of the predetermined one of the side switches S2 can be simultaneously performed.

In the embodiment, the closed or opened states of the center switch S1 and the four side switches S2 can be independently switched over by pressing or tilting the single operation member 7. Alternatively, operation members may be respectively disposed for the center switch S1 and the four side switches S2, and the closed or opened states of the center switch S1 and the four side switches S2 can be independently switched over by independently operating the operation members. Each of the movable electrodes 41 and 42 of the center switch S1 and the side switches S2 is formed by the circular dome-like snap plate which upward swells. The movable electrodes may be formed by snap plates of another shape (for example, rectangular) and having an arcuate section shape which upward swells.

In the embodiment, the common terminal 33 is formed as a common terminal which is in contact with both the movable electrode 41 of the center switch S1 and the movable electrode 42 of the corresponding one of the four side switches S2. Even when the overlapping portions of the movable electrodes 41 and 42 of the switches S1 and S2 are in contact with each other, therefore, there arises no problem in the opening and closing operations of the switches. When the overlapping portions of the movable electrodes 41 and 42 are in contact with each other, however, there is a fear that the movable electrodes 41 and 42 may be damaged because, when the movable electrode 42 of one of the side switches S2 is flexurally deformed, for example, the movable electrode 42 rubs against the movable electrode 41 of the center switch S1. In order to solve this problem, it is effective to form gaps U between the upper face of the movable electrode 41 of the center switch S1 and the outer peripheral edges of the movable electrodes 42 of the side switches S2, respectively. In the case where such gaps U are formed, it desirable to form the gaps U so that, when each of the movable electrodes 42 of the side switches S2 is pressed by the operation member 7 or the movable member 6 to be flexurally deformed, displacement of the outer peripheral edge of the movable electrode 42 is absorbed by the corresponding one of the gaps U. According to this configuration, when one of the movable electrodes 42 of the side switches S2 is flexurally deformed, the outer peripheral edge of the movable electrode 42 is prevented from rubbing against the movable electrode 41 of the center switch S1. Therefore, a situation in which the movable electrodes 42 and 41 are damaged does not occur. In order to form the gaps U, it is effective to increase the level difference between the bottom face 22*a* of the center recess 22 and the bottom face 21*a* of each of the surrounding recesses 21, i.e., the step H.

In the multi-contact inputting device of the embodiment, the steps H are formed between the bottom face 22*a* of the center recess 22 into which the movable electrode 41 of the center switch S1 is fitted, and the bottom faces 21*a* of the recesses 21 into which the movable electrodes 42 of the side switches S2 are fitted, so that the movable electrodes 41 and 42 are placed in an overlapping manner. In order to place the movable electrodes 41 and 42 in an overlapping manner, it is not always necessary to form the steps H. For example, the movable electrodes 41 and 42 may be positioned by using fixation means including an adhesive tape or the like so as to be placed in an overlapping manner. The movable electrodes 42 of the side switches S2 are individually formed. Alternatively, two or all of the electrodes may be formed as an integral member.

The entire disclosure of Japanese Patent Application No. 2000-92065 filed on Mar. 29, 2000 including specification, claims, drawings and summary are incorporated herein by reference in its entirety.

What is claimed is:

1. A multi-contact inputting device comprising: a center switch; plural side switches which are placed around said center switch, each of said center switch and said side switches is formed by: a stationary electrode disposed in a body; and a movable electrode configured by a snap plate which is placed so as to be separable from and contactable with said stationary electrode, and to cover said stationary electrode; and an operation member which can individually open and close said center switch and said side switches, wherein said plural side switches are placed so that a part of said movable electrode of each of said side switches overlaps with said movable electrode of said center switch in a thickness direction of said body.

2. A multi-contact inputting device according to claim 1, wherein said device further comprises positioning means for positioning said movable electrode of said center switch and said movable electrodes of said side switches to predetermined positions which are formed by partitioning said body.

3. A multi-contact inputting device according to claim 2, wherein a recess into which said movable electrode of said center switch is to be fitted, and recesses into which said movable electrodes of said side switches are to be respectively fitted are disposed in said body, and said positioning means is formed by said recesses.

4. A multi-contact inputting device according to claim 3, wherein said movable electrode of said center switch and said movable electrodes of said side switches have an arcuate section shape which upward swells, an outer peripheral edge of said movable electrode of said center switch is seated on a bottom face of said recess for positioning said movable electrode of said center switch, outer peripheral edges of said movable electrodes of said side switches are seated on bottom faces of said recesses for positioning said movable electrode of said side switches, respectively, and steps are formed between said bottom face of said recess for positioning said movable electrode of said center switch and said bottom faces of said recesses for positioning said movable electrode of said side switches, respectively.

5. A multi-contact inputting device according to claim 4, wherein said bottom faces of said recesses into which said movable electrodes of said side switches are to be fitted, respectively are higher in level than said bottom face of said recess into which said movable electrode of said center switch is to be fitted.

6. A multi-contact inputting device according to claim 5, wherein a common terminal is placed on said bottom face of said recess into which said movable electrode of said center switch is to be fitted, and said bottom faces of said recesses into which said movable electrode of said side switches are to be fitted, respectively, and the outer peripheral edge of said movable electrode of said center switch and the outer peripheral edges of said movable electrodes of said side switches are in contact with said common terminal.

7. A multi-contact inputting device according to claim 5, wherein gaps are formed between an upper face of said movable electrode of said center switch and the outer peripheral edges of said movable electrodes of said side switches, respectively, each of said gaps having an area which can absorb displacement of the outer peripheral edge of said movable electrode of corresponding one of said side switches due to flexural deformation that is caused when said movable electrode is pressed down by said operation member.

8. A multi-contact inputting device according to claim 4, wherein a common terminal is placed on said bottom face of said recess into which said movable electrode of said center switch is to be fitted, and said bottom faces of said recesses into which said movable electrode of said side switches are to be fitted, respectively, and the outer peripheral edge of said movable electrode of said center switch and the outer peripheral edges of said movable electrodes of said side switches are in contact with said common terminal.

9. A multi-contact inputting device according to claim 8, wherein gaps are formed between an upper face of said movable electrode of said center switch and the outer peripheral edges of said movable electrodes of said side switches, respectively, each of said gaps having an area which can absorb displacement of the outer peripheral edge of said movable electrode of corresponding one of said side switches due to flexural deformation that is caused when said movable electrode is pressed down by said operation member.

10. A multi-contact inputting device according to claim 3, wherein said side switches are placed in four positions at regular angular intervals around said single center switch, respectively, said movable electrode of said center switch and said movable electrodes of said side switches are configured by dome-like snap plates which have a circular shape in a plan view, and which have the same shape and size, respectively, said recesses for positioning said movable electrodes of said side switches are separated from one another by four partition walls which form said recesses, and a recess surrounded by inner end faces of said partition walls is formed as said recess for positioning said movable electrode of said center switch.

* * * * *

UNITED STATES PATENT AND TRADEMARK OFFICE

CERTIFICATE OF CORRECTION

PATENT NO. : 6,262,381 B1
DATED : July 17, 2001
INVENTOR(S) : Toshio Kikuchi et al.

It is certified that error appears in the above-identified patent and that said Letters Patent is hereby corrected as shown below:

Column 9,
Line 7, “5” should be -- 4 --.
Line 26, “4” should be -- 5 --.

Column 10,
Line 5, “8” should be -- 6 --.

Signed and Sealed this

Thirtieth Day of July, 2002

*Attest:*

*Attesting Officer*

JAMES E. ROGAN
*Director of the United States Patent and Trademark Office*